US008255232B2

(12) United States Patent
Wang

(10) Patent No.: US 8,255,232 B2
(45) Date of Patent: Aug. 28, 2012

(54) AUDIO ENCODING METHOD WITH FUNCTION OF ACCELERATING A QUANTIZATION ITERATIVE LOOP PROCESS

(75) Inventor: Wen-Haw Wang, Keelung (TW)

(73) Assignee: RealTek Semiconductor Corp., Hsinchu (TW)

( * ) Notice: Subject to any disclaimer, the term of this patent is extended or adjusted under 35 U.S.C. 154(b) by 1063 days.

(21) Appl. No.: 12/183,031

(22) Filed: Jul. 30, 2008

(65) Prior Publication Data

US 2009/0037166 A1 Feb. 5, 2009

(30) Foreign Application Priority Data

Jul. 31, 2007 (TW) ..... 96128112 A

(51) Int. Cl.

| | |
|---|---|
| ***G10L 19/00*** | (2006.01) |
| ***G10L 19/02*** | (2006.01) |
| ***G10L 21/00*** | (2006.01) |
| *G10L 19/04* | (2006.01) |

(52) U.S. Cl. ..... 704/501; 704/201; 704/205; 704/229; 704/500

(58) Field of Classification Search ..... None
See application file for complete search history.

(56) References Cited

U.S. PATENT DOCUMENTS

| | | | | |
|---|---|---|---|---|
| 6,104,996 | A | 8/2000 | Yin | |
| 6,138,051 | A | 10/2000 | Dieterich | |
| 6,456,968 | B1 | 9/2002 | Taniguchi | |
| 6,678,648 | B1 | 1/2004 | Surucu | |
| 6,725,192 | B1 * | 4/2004 | Araki | 704/230 |
| 6,732,071 | B2 | 5/2004 | Lopez-Estrada | |
| 6,950,794 | B1 | 9/2005 | Subramaniam | |
| 2004/0143431 | A1 * | 7/2004 | Hsu | 704/205 |
| 2004/0162720 | A1 * | 8/2004 | Jang et al. | 704/200.1 |
| 2005/0200505 | A1 * | 9/2005 | Venkatesha Rao et al. | 341/65 |
| 2006/0015332 | A1 * | 1/2006 | Chen et al. | 704/230 |
| 2006/0047522 | A1 * | 3/2006 | Ojanpera | 704/503 |
| 2006/0047523 | A1 * | 3/2006 | Ojanpera | 704/503 |

(Continued)

FOREIGN PATENT DOCUMENTS

CN 1741393 A 3/2006

(Continued)

OTHER PUBLICATIONS

Chun-Yi Lee et al.,A Fast Audio Bit Allocation Technique Based on a Linear R-D Model, Aug. 2002, p. 662-670, vol. 48, No. 3, IEEE Transactions on Consumer Electronics.

(Continued)

*Primary Examiner* — Justin Rider
(74) *Attorney, Agent, or Firm* — Thomas, Kayden, Horstemeyer & Risley, LLP

(57) ABSTRACT

An audio encoding method previously estimates better initial iterative values of global-gain and scalefactor for avoiding heavy calculation. The estimating process of the encoding method includes calculating the bit allocation of one frequency sample based on a sampling rate, a bit rate, and the number of audio channels according to an input frame, and the psychoacoustic model, searching one frequency sample having the greatest sample energy in each of a plurality of scalefactor bands, quantizing the frequency sample to comply with the bit allocation and to generate a corresponding scalefactor, searching a maximum scalefactor of all scalefactor bands corresponding to the input frame, and setting initial values of scalefactors and an initial value of global-gain for the quantization iterative loop process according to the corresponding scalefactor and the maximum scalefactor.

18 Claims, 4 Drawing Sheets

U.S. PATENT DOCUMENTS

| | | | | |
|---|---|---|---|---|
| 2006/0074693 | A1* | 4/2006 | Yamashita | 704/500 |
| 2007/0033024 | A1* | 2/2007 | Budnikov et al. | 704/230 |
| 2007/0250308 | A1* | 10/2007 | Lee et al. | 704/200 |

FOREIGN PATENT DOCUMENTS

| | | |
|---|---|---|
| TW | 200414126 | 8/2004 |
| TW | I231656 | 4/2005 |
| TW | 200627379 | 8/2006 |
| TW | 200705385 | 2/2007 |

OTHER PUBLICATIONS

Xu Sheng et al., "Improved MPEG-2 AAC quantization module with PE-based algorithm", Journal of China Institute of Communications, vol. 22, No. 10, Oct. 2001, p. 6-11, 1994-2010 China Academic Journal Electronic Publishing House.

* cited by examiner

AUDIO ENCODING METHOD WITH FUNCTION OF ACCELERATING A QUANTIZATION ITERATIVE LOOP PROCESS

BACKGROUND OF THE INVENTION

1. Field of the Invention

The present invention relates in general to an audio encoding method, and more particularly, to an audio encoding method with function of accelerating a quantization iterative loop process.

2. Description of the Prior Art

At present, many coding apparatuses are based on different coding algorithms, such as MP3 (MPEG audio layer III), AAC (Advanced Audio Coding), and Dolby Digital™. These coding algorithms take into account the characteristics of the human auditory system, and have the advantage of high compression ratio (generally more than ten times). These coding apparatuses adopt perceptual coding, frequency domain coding, window switching, dynamic bit allocation technologies, etc to eliminate unnecessary content of the original audio data.

Please refer to FIG. 1, which is a flowchart depicting a prior art audio encoding method. The prior art audio encoding method comprises the following steps:

Step S100: furnish an input frame having pulse code modulation;

Step S110: convert the input frame from time-domain to frequency-domain to generate a plurality of frequency samples corresponding to the input frame;

Step S130: analyze an amount of available bits for calculating a number of available bits;

Step S140: reset iterative variables corresponding to an outer quantization iterative loop encoding process;

Step S150: detect whether all the sample energies corresponding to the plurality of frequency samples are equal to zero, if all the sample energies corresponding to the plurality of frequency samples are equal to zero, then go to step S170, else go to step S160;

Step S160: perform the outer quantization iterative loop encoding process to generate a coded frame;

Step S170: analyze an amount of unused bits for calculating a number of unused bits, which is provided as the information of available bits for subsequent signal processing; and Step S180: finished.

In the aforementioned prior art audio encoding method, the initial values of the iterative variables, such as scalefactors and global gain, for performing the outer quantization iterative loop encoding process are all set to zero. Accordingly, significant differences between the initial values and expectation values concerning the iterative variables are likely to occur, and heavy calculation is required for performing the outer quantization iterative loop encoding process to achieve the expectation values. It is therefore not efficient to adopt the prior art audio encoding method for encoding input frames.

SUMMARY OF THE INVENTION

In accordance with an embodiment of the present invention, an audio encoding method with function of accelerating a quantization iterative loop encoding process is provided for generating a coded frame by encoding an input frame. The audio encoding method comprises converting the input frame from time-domain to frequency-domain to generate a plurality of frequency samples corresponding to the input frame, wherein the frequency-domain is partitioned into a plurality of scalefactor bands, calculating a bit allocation corresponding to the plurality of frequency samples in the plurality of scalefactor bands according to at least one parameter, selecting at least one frequency sample in each of the plurality of scalefactor bands, and quantizing a plurality of frequency samples being selected to generate a plurality of scalefactors, wherein a bit number of the quantized frequency samples is corresponding to the bit allocation, and performing a quantization iterative loop encoding process to generate the coded frame based on the scalefactors.

The present invention further provides an audio encoding method with function of accelerating a quantization iterative loop encoding process for generating a coded frame by encoding an input frame. The audio encoding method comprises converting the input frame from time-domain to frequency-domain to generate a plurality of frequency samples, generating initial values of a plurality of scalefactors and an initial value of a global-gain according to the plurality of frequency samples, and performing a quantization iterative loop encoding process to generate the coded frame based on the initial values of the plurality of scalefactors and the initial value of the global-gain.

These and other objectives of the present invention will no doubt become obvious to those of ordinary skill in the art after reading the following detailed description of the preferred embodiment that is illustrated in the various figures and drawings.

DETAILED DESCRIPTION

Hereinafter, preferred embodiments of the audio encoding method according to the present invention will be described in detail with reference to the accompanying drawings. Here, it is to be noted that the present invention is not limited thereto. Furthermore, the step serial numbers concerning the flowchart of the audio encoding method are not meant thereto limit the operating sequence, and any rearrangement of the operating sequence for achieving same functionality is still within the spirit and scope of the invention.

Figure 1:
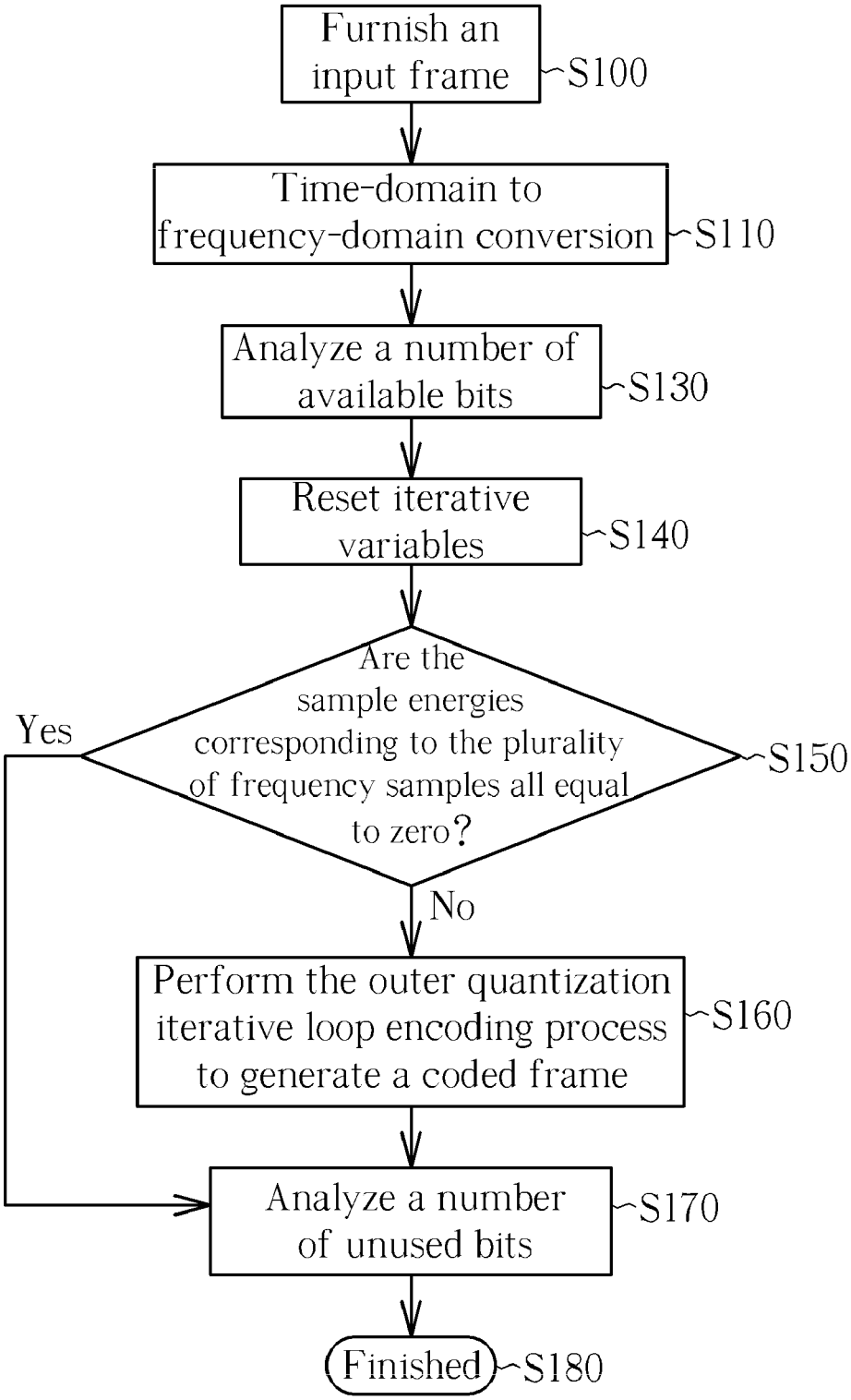
FIG. 1 PRIOR ART
FIG. 1 is a flowchart depicting a prior art audio encoding method.
Figure 2:
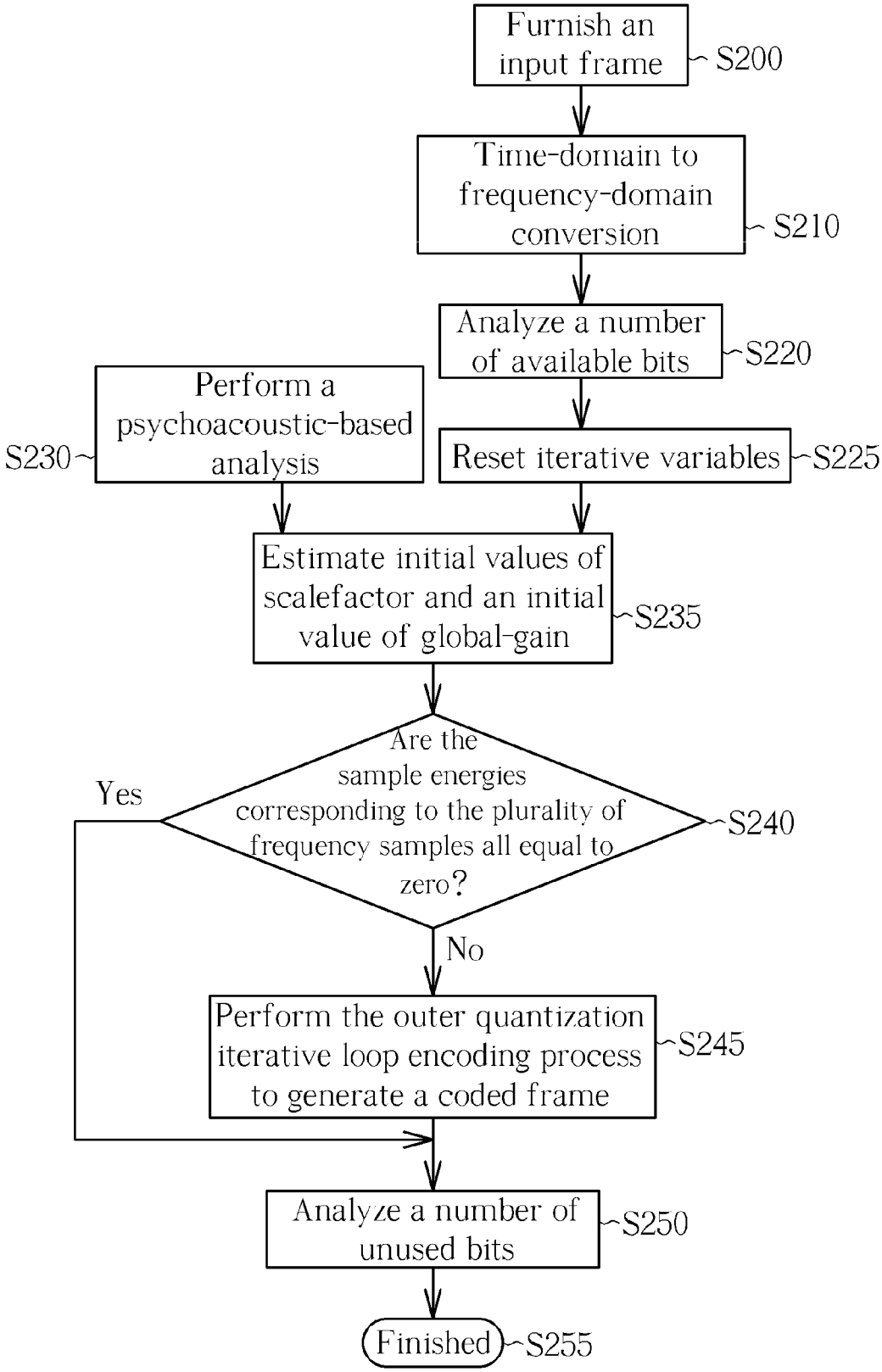
FIG. 2 is a flowchart depicting an audio encoding method in accordance with a first embodiment of the present invention.

Please refer to FIG. 2, which is a flowchart depicting an audio encoding method in accordance with a first embodiment of the present invention. The audio encoding method comprises the following steps:

Step S200: furnish an input frame having pulse code modulation;

Step S210: convert the input frame from time-domain to frequency-domain to generate a plurality of frequency samples corresponding to the input frame, wherein the frequency-domain is partitioned into a plurality of scalefactor bands;

Step S220: analyze an amount of available bits for calculating a number of available bits;

Step S225: reset iterative variables corresponding to an outer quantization iterative loop encoding process;

Step S230: perform a psychoacoustic-based analysis on the input frame to generate a masking curve;

Step S235: estimate initial values of scalefactors and an initial value of global-gain according to the plurality of frequency samples and the masking curve;

Step S240: detect whether all the sample energies corresponding to the plurality of frequency samples are equal to zero, if all the sample energies corresponding to the plurality of frequency samples are equal to zero, then go to step S250, else go to step S245;

Step S245: perform the outer quantization iterative loop encoding process to generate a coded frame based on the initial values of scalefactors and the initial value of global-gain corresponding to each of the plurality of scalefactor bands;

Step S250: analyze an amount of unused bits for calculating a number of unused bits, which is provided as the information of available bits for subsequent signal processing; and Step S255: finished.

In the step 235 of the aforementioned audio encoding method, the estimation of the initial values of scalefactors and the initial value of global-gain is carried out based on the characteristics of the frequency samples and the masking curve corresponding to the input frame. That is, the initial values of scalefactors and the initial value of global-gain required by the outer quantization iterative loop encoding process are generated through proper calculating. Accordingly, significant differences between the initial values and expectation values will not occur so that heavy calculation in performing quantization iterative loop can be avoided. Please note that the step S230 is limited to be performed prior to the step S235 and is not limited to be performed after the step S225.

Furthermore, in the step S210, when the audio encoding method is applied to an MP3 encoding process, a polyphase filtering process is also carried out on the input frame having pulse code modulation for generating a plurality of subband samples. Still more, each of the plurality of subband samples can be partitioned by a modified discrete cosine transform (MDCT) into a plurality of short or long time windows so that a higher frequency resolution can be achieved. However, when the audio encoding method is applied to an AAC encoding process, the polyphase filtering process can be omitted.

Moreover, in the step S245, the outer quantization iterative loop encoding process comprises an inner quantization iterative loop encoding process. The inner quantization iterative loop encoding process is carried out for performing a quantization process according to the global-gain. A bit number required for encoding a quantization value in the quantization process is also calculated through the inner quantization iterative loop encoding process. For instance, the bit number can be a number required for encoding the quantization value in the MP3 encoding process based on a Huffman encoding scheme. In addition, when the bit number being calculated is greater than a bit allocation, the global-gain is adjusted through the inner quantization iterative loop encoding process, and the inner quantization iterative loop encoding process is going on until the bit number is not greater than the bit allocation. In the step S250, the number of unused bits can be utilized to analyze a bit allocation of a frequency sample in each of a plurality of scalefactor bands corresponding to a subsequent input frame.

Figure 3:
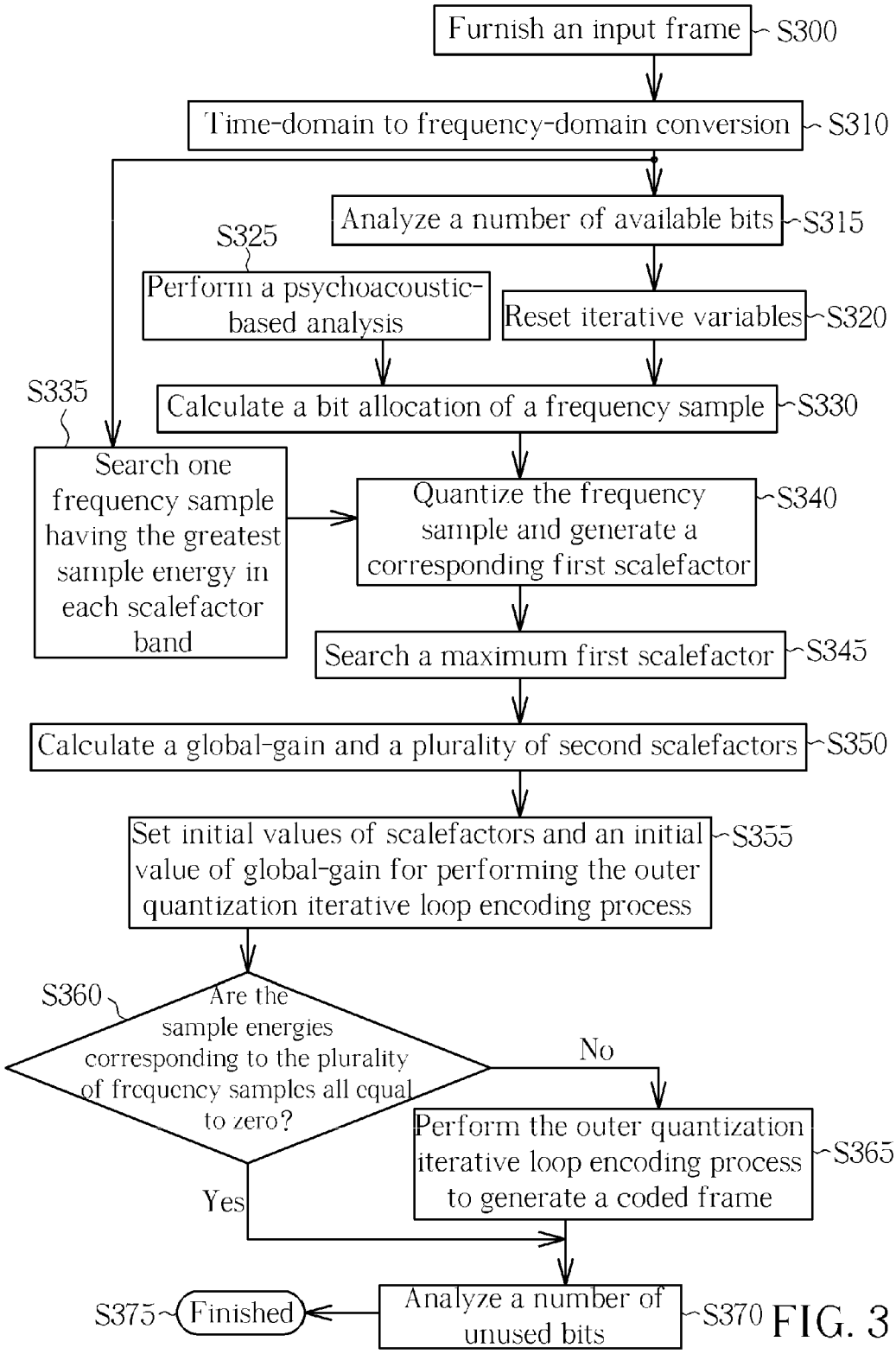
FIG. 3 is a flowchart depicting an audio encoding method in accordance with a second embodiment of the present invention.

Please refer to FIG. 3, which is a flowchart depicting an audio encoding method in accordance with a second embodiment of the present invention. The audio encoding method comprises the following steps:

Step S300: furnish an input frame having pulse code modulation;

Step S310: convert the input frame from time-domain to frequency-domain to generate a plurality of frequency samples corresponding to the input frame, wherein the frequency-domain is partitioned into a plurality of scalefactor bands;

Step S315: analyze an amount of available bits for calculating a number of available bits;

Step S320: reset iterative variables corresponding to an outer quantization iterative loop encoding process;

Step S325: perform a psychoacoustic-based analysis on the input frame to generate a masking curve;

Step S330: calculate a bit allocation of a frequency sample in each of the plurality of scalefactor bands corresponding to the input frame based on the masking curve in conjunction with a sampling rate, a bit rate and a number of audio channels concerning the input frame;

Step S335: search one frequency sample having the greatest sample energy in each of the plurality of scalefactor bands;

Step S340: quantize the frequency sample having the greatest sample energy in each of the plurality of scalefactor bands based on a quantization step so that the bit number of the frequency sample is complied with the bit allocation calculated for the frequency sample, and generate a first scalefactor correspondingly. For instance, when the bit number of the frequency sample is eight and the corresponding bit allocation calculated for the frequency sample is four, the frequency sample will be quantized from an eight-bit frequency sample to a four-bit frequency sample based on the quantization step and the first scalefactor is generated correspondingly;

Step S345: search a maximum first scalefactor from the first scalefactors corresponding to the frequency samples having the greatest sample energy in each of the plurality of scalefactor bands;

Step S350: calculate or set a global-gain based on the maximum first scalefactor, and generate a plurality of second scalefactors by subtracting the maximum first scalefactor from the first scalefactors;

Step S355: set initial values of scalefactors and an initial value of global-gain corresponding to each of the plurality of scalefactor bands to be the second scalefactors and the global-gain respectively for performing the outer quantization iterative loop encoding process;

Step S360: detect whether all the sample energies corresponding to the plurality of frequency samples in the plurality of scalefactor bands are equal to zero, if all the sample energies corresponding to the plurality of frequency samples are equal to zero, then go to step S370, else go to step S365;

Step S365: perform the outer quantization iterative loop encoding process to generate a coded frame based on the initial values of scalefactors and the initial value of global-gain corresponding to each of the plurality of scalefactor bands;

Step S370: analyze an amount of unused bits for calculating a number of unused bits, which is provided as the information of available bits for subsequent signal processing; and Step S375: finished.

In the aforementioned audio encoding method, while performing the outer quantization iterative loop encoding process on the input frame, the initial values of scalefactors and the initial value of global-gain corresponding to each of the plurality of scalefactor bands are estimated based on the steps S340 through S355. That is, the initial values of scalefactors and the initial value of global-gain are corresponded to the sample energies of the frequency samples. Accordingly, significant differences between the initial values and expectation values will not occur so that heavy calculation in performing quantization iterative loop can be avoided.

Furthermore, in the step S310, when the audio encoding method is applied to the AAC encoding process, the process of converting the input frame from time-domain to frequency-domain comprises the modified discrete cosine transform (MDCT). When the audio encoding method is applied to the MP3 encoding process, the process of converting the input frame from time-domain to frequency-domain comprises the polyphase filtering process for generating a plurality of subband samples and the modified discrete cosine transform (MDCT). In the step S350, the purpose of subtracting the maximum first scalefactor from the first scalefactors to generate the plurality of second scalefactors is to comply with the MP3 encoding process or the AAC encoding process in that the scalefactors used in the MP3 encoding process or the AAC encoding process are non-positive factors.

Moreover, in the step S365, the outer quantization iterative loop encoding process comprises an inner quantization iterative loop encoding process. The inner quantization iterative loop encoding process is carried out for performing a quantization process according to the global-gain. A bit number required for encoding a quantization value in the quantization process is also calculated through the inner quantization iterative loop encoding process. Still more, when the bit number being calculated is greater than a bit allocation, the global-gain is adjusted through the inner quantization iterative loop encoding process, and the inner quantization iterative loop encoding process is going on until the bit number is not greater than the bit allocation.

In addition, in the step S325, the process of performing the psychoacoustic-based analysis on the input frame to generate the masking curve comprises setting an energy distortion threshold corresponding to each of the plurality of scalefactor bands according to the masking curve. Please note that the step S325 is limited to be performed prior to the step S330 and is not limited to be performed after the step S320. In the step S365, the process of performing the outer quantization iterative loop encoding process comprises calculating an energy distortion value corresponding to each of the plurality of scalefactor bands, and adjusting the scalefactors corresponding to the scalefactor bands in a corresponding subband sample of the input frame for continuing operating the outer quantization iterative loop encoding process when the energy distortion value of a frequency sample corresponding to a scalefactor band in the corresponding subband sample is greater than the energy distortion threshold. In the step S370, the number of unused bits can be utilized to analyze a bit allocation of a frequency sample in each of a plurality of scalefactor bands corresponding to a subsequent input frame.

Figure 4:
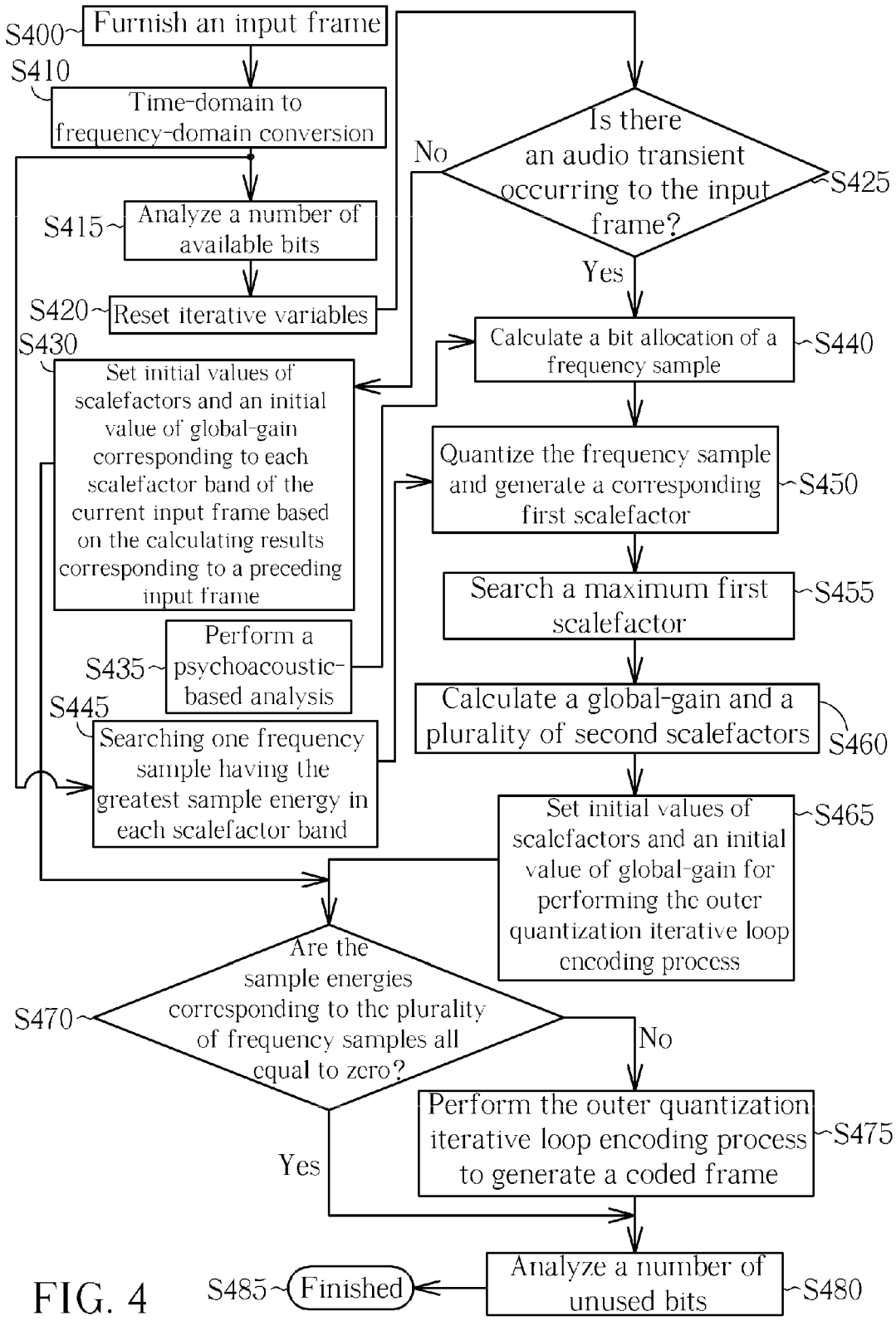
FIG. 4 is a flowchart depicting an audio encoding method in accordance with a third embodiment of the present invention.

Please refer to FIG. 4, which is a flowchart depicting an audio encoding method in accordance with a third embodiment of the present invention. The audio encoding method comprises the following steps:

Step S400: furnish an input frame having pulse code modulation;

Step S410: convert the input frame from time-domain to frequency-domain to generate a plurality of frequency samples corresponding to the input frame, wherein the frequency-domain is partitioned into a plurality of scalefactor bands;

Step S415: analyze an amount of available bits for calculating a number of available bits;

Step S420: reset iterative variables corresponding to an outer quantization iterative loop encoding process;

Step S425: detect whether there is an audio transient occurring to the input frame, if there is an audio transient occurring to the input frame, then go to step S440, else go to step S430;

Step S430: set initial values of scalefactors and an initial value of global-gain corresponding to each of the plurality of scalefactor bands of the current input frame based on the calculating results corresponding to a preceding input frame for performing the outer quantization iterative loop encoding process, go to step S470;

Step S435: perform a psychoacoustic-based analysis on the input frame to generate a masking curve;

Step S440: calculate a bit allocation of a frequency sample in each of the plurality of scalefactor bands corresponding to a plurality of subband samples of the input frame based on the masking curve in conjunction with a sampling rate, a bit rate and a number of audio channels concerning the input frame;

Step S445: searching one frequency sample having the greatest sample energy in each of the plurality of scalefactor bands;

Step S450: quantize the frequency sample having the greatest sample energy in each of the plurality of scalefactor bands based on a quantization step so that the bit number of the frequency sample is complied with the bit allocation calculated for the frequency sample, and generate a first scalefactor correspondingly;

Step S455: search a maximum first scalefactor corresponding to the plurality of scalefactor bands from the first scalefactors corresponding to the frequency samples having the greatest sample energy in each of the plurality of scalefactor bands;

Step S460: calculate a global-gain based on the maximum first scalefactor, and generate a plurality of second scalefactors by subtracting the maximum first scalefactor from the first scalefactors;

Step S465: set initial values of scalefactors and an initial value of global-gain corresponding to each of the plurality of scalefactor bands to be the second scalefactors and the global-gain respectively for performing the outer quantization iterative loop encoding process;

Step S470: detect whether all the sample energies corresponding to the plurality of frequency samples in the plurality of scalefactor bands are equal to zero, if all the sample energies corresponding to the plurality of frequency samples are equal to zero, then go to step S480, else go to step S475;

Step S475: perform the outer quantization iterative loop encoding process to generate a coded frame based on the initial values of scalefactors and the initial value of global-gain corresponding to each of the plurality of scalefactor bands;

Step S480: analyze an amount of unused bits for calculating a number of unused bits, which is provided as the information of available bits for subsequent signal processing; and Step S485: finished.

In the aforementioned audio encoding method, there are two processes for determining the initial values of scalefactors and the initial value of global-gain corresponding to each of the plurality of scalefactor bands for performing the outer quantization iterative loop encoding process, and the selection for one of the two processes to be carried out is performed by detecting whether there is an audio transient occurring to the input frame. When there is no audio transient occurring to the input frame, the initial values of scalefactors and the initial value of global-gain corresponding to each of the plurality of scalefactor bands of the current input frame are determined based on the calculating results corresponding to the preceding input frame for performing the outer quantization iterative loop encoding process. When there is an audio transient occurring to the input frame, an estimation process based on the steps S435 through S465 for determining the initial values of scalefactors and the initial value of global-gain corresponding to each of the plurality of scalefactor bands of the current input frame for performing the outer quantization iterative loop encoding process is performed.

In one embodiment, the difference between the masking curve corresponding to the current input frame and the masking curve corresponding to the preceding input frame can be utilized to detect whether there is an audio transient occurring to the current input frame. When the difference between two masking curves is greater than a threshold, the situation that an audio transient occurs to the current input frame is confirmed. Accordingly, heavy calculation in performing quantization iterative loop caused by the audio transient between adjacent input frames can be avoided.

In the step S460, the purpose of subtracting the maximum first scalefactor from the first scalefactors to generate the plurality of second scalefactors is to comply with the MP3 encoding process or the AAC encoding process. Moreover, in the step S475, the outer quantization iterative loop encoding process comprises an inner quantization iterative loop encoding process. The inner quantization iterative loop encoding process is carried out for performing a quantization process according to the global-gain. A bit number required for encoding a quantization value in the quantization process is calculated through the inner quantization iterative loop encoding process. Still more, when the bit number being calculated is greater than a bit allocation, the global-gain is adjusted through the inner quantization iterative loop encoding process, and the inner quantization iterative loop encoding process is going on until the bit number is not greater than the bit allocation.

In addition, in the step S435, the process of performing the psychoacoustic-based analysis on the input frame to generate the masking curve comprises setting an energy distortion threshold corresponding to each of the plurality of scalefactor bands according to the masking curve. Please note that the step S435 is limited to be performed prior to the step S440 and is not limited to be performed after the step S425. In the step S475, the process of performing the outer quantization iterative loop encoding process comprises calculating an energy distortion value corresponding to each of the plurality of scalefactor bands, and adjusting the scalefactors corresponding to the scalefactor bands in the corresponding subband sample for continuing operating the outer quantization iterative loop encoding process when the energy distortion value of a frequency sample corresponding to a scalefactor band in the corresponding subband sample is greater than the energy distortion threshold. In the step S480, the number of unused bits can be utilized to analyze a bit allocation of a frequency sample in each of a plurality of scalefactor bands corresponding to a subsequent input frame.

To sum up, by making use of an estimation process for determining the initial values of scalefactors and the initial value of global-gain corresponding to each of the plurality of scalefactor bands for performing the outer quantization iterative loop encoding process, the audio encoding method of the present invention is capable of accelerating the quantization iterative loop encoding process by avoiding the demand for heavy calculation.

Those skilled in the art will readily observe that numerous modifications and alterations of the device and method may be made while retaining the teachings of the invention.

What is claimed is:

1. An audio encoding method, executed by a processor in an audio coding apparatus, for generating a coded frame by encoding an input frame comprising:

converting the input frame from time-domain to frequency-domain to generate a plurality of frequency samples, wherein the frequency-domain is partitioned into a plurality of scalefactor bands;

calculating a bit allocation corresponding to the plurality of frequency samples in the plurality of scalefactor bands according to at least one parameter;

selecting at least one frequency sample in each of the plurality of scalefactor bands, and quantizing a plurality of frequency samples being selected to generate a plurality of scalefactors, wherein a bit number of the quantized frequency samples is corresponding to the bit allocation;

performing a quantization iterative loop encoding process to generate the coded frame based on the scalefactors; and searching for one frequency sample having the greatest sample energy in each of the plurality of scalefactor bands, wherein the plurality of frequency samples being selected to be quantized are the frequency samples having the greatest sample energy in each of the plurality of scalefactor bands.

2. An audio encoding method, executed by a processor in an audio coding apparatus, for generating a coded frame by encoding an input frame comprising:

converting the input frame from time-domain to frequency-domain to generate a plurality of frequency samples, wherein the frequency-domain is partitioned into a plurality of scalefactor bands;

calculating a bit allocation corresponding to the plurality of frequency samples in the plurality of scalefactor bands according to at least one parameter;

selecting at least one frequency sample in each of the plurality of scalefactor bands, and quantizing a plurality of frequency samples being selected to generate a plurality of scalefactors, wherein a bit number of the quantized frequency samples is corresponding to the bit allocation;

performing a quantization iterative loop encoding process to generate the coded frame based on the scalefactors;

performing a psychoacoustic-based analysis on the input frame to generate a masking curve; and using the scalefactors corresponding to a preceding input frame to perform the quantization iterative loop encoding process when a difference between a masking curve corresponding to the input frame and a masking curve corresponding to the preceding input frame is less than a threshold.

3. The audio encoding method of claim 2, wherein the parameter comprises a sampling rate, a bit rate, a number of audio channels, and the masking curve.

4. The audio encoding method of claim 1, wherein quantizing the plurality of frequency samples being selected to generate the plurality of scalefactors is quantizing the plurality of frequency samples being selected based on a quantization step to generate the plurality of scalefactors.

5. An audio encoding method, executed by a processor in an audio coding apparatus, for generating a coded frame by encoding an input frame comprising:

converting the input frame from time-domain to frequency-domain to generate a plurality of frequency samples, wherein the frequency-domain is partitioned into a plurality of scalefactor bands;

calculating a bit allocation corresponding to the plurality of frequency samples in the plurality of scalefactor bands according to at least one parameter;

selecting at least one frequency sample in each of the plurality of scalefactor bands, and quantizing a plurality of frequency samples being selected to generate a plurality of scalefactors, wherein a bit number of the quantized frequency samples is corresponding to the bit allocation; and performing a quantization iterative loop encoding process to generate the coded frame based on the scalefactors, wherein quantizing the plurality of frequency samples being selected to generate the plurality of scalefactors further comprises:

quantizing the plurality of frequency samples being selected to generate a plurality of first scalefactors; and subtracting a value from the plurality of first scalefactors to generate the plurality of scalefactors;

wherein the value is the greatest value of the plurality of first scalefactors.

6. The audio encoding method of claim 5, wherein the plurality of scalefactors are used as the initial values for performing the quantization iterative loop encoding process, and the value is used as a gain for performing the quantization iterative loop encoding process.

7. The audio encoding method of claim 1, further comprising:

quantizing the plurality of frequency samples being selected to generate a gain corresponding to the plurality of scalefactors; and performing the quantization iterative loop encoding process to generate the coded frame based on the plurality of scalefactors and the gain.

8. The audio encoding method of claim 1, further comprising:

analyzing an amount of available bits to calculate a number of available bits.

9. The audio encoding method of claim 1, further comprising:

analyzing an amount of unused bits to calculate a number of unused bits.

10. The audio encoding method of claim 1, wherein the quantization iterative loop encoding process comprises performing a Huffman encoding.

11. The audio encoding method of claim 1, further comprising:

calculating an energy distortion value corresponding to each of the plurality of scalefactor bands.

12. The audio encoding method of claim 11, further comprising:

adjusting the plurality of scalefactors to operate the quantization iterative loop encoding process when the energy distortion value is greater than a threshold.

13. An audio encoding method, executed in an audio coding apparatus, for generating a coded frame by encoding an input frame comprising:

converting the input frame from time-domain to frequency-domain to generate a plurality of frequency samples;

generating initial values of a plurality of scalefactors and an initial value of a global-gain according to the plurality of frequency samples; and performing a quantization iterative loop encoding process to generate the coded frame based on the initial values of the plurality of scalefactors and the initial value of the global-gain.

14. The audio encoding method of claim 13, wherein the frequency-domain is partitioned into a plurality of scalefactor bands and the audio encoding method further comprises:

selecting at least one frequency sample in each of the plurality of scalefactor bands, and quantizing the plurality of frequency samples being selected to generate the initial values of the plurality of scalefactors.

15. The audio encoding method of claim 14, further comprising:

searching for one frequency sample having the greatest sample energy in each of the plurality of scalefactor bands, wherein the plurality of frequency samples being selected to be quantized is the frequency samples having the greatest sample energy in each of the plurality of scalefactor bands.

16. The audio encoding method of claim 13, wherein the frequency-domain is partitioned into a plurality of scalefactor bands and the audio encoding method further comprises:

calculating a bit allocation corresponding to the plurality of frequency samples in the plurality of scalefactor bands according to at least one parameter.

17. The audio encoding method of claim 13, wherein all the scalefactors are less than zero or equal to zero.

18. The audio encoding method of claim 13, wherein the audio encoding method is applied to an MP3 (MPEG audio layer III, MP3) audio encoding process or an AAC (Advanced Audio Coding, AAC) audio encoding process.

* * * * *